US007749102B2

(12) United States Patent
Nakamura

(10) Patent No.: US 7,749,102 B2
(45) Date of Patent: Jul. 6, 2010

(54) IRON-TYPE GOLF CLUB HEAD

(75) Inventor: Takashi Nakamura, Kobe (JP)

(73) Assignee: SRI Sports Limited, Kobe (JP)

( * ) Notice: Subject to any disclaimer, the term of this patent is extended or adjusted under 35 U.S.C. 154(b) by 97 days.

(21) Appl. No.: 12/073,322

(22) Filed: Mar. 4, 2008

(65) Prior Publication Data

US 2008/0287216 A1 Nov. 20, 2008

(30) Foreign Application Priority Data

May 17, 2007 (JP) ..... 2007-131858

(51) Int. Cl.
*A63B 53/04* (2006.01)

(52) U.S. Cl. ..... 473/342; 473/349; 473/350

(58) Field of Classification Search ..... 473/324–350, 473/287–292
See application file for complete search history.

(56) References Cited

U.S. PATENT DOCUMENTS 5,024,437 A * 6/1991 Anderson ..... 473/342
5,094,383 A * 3/1992 Anderson et al. ..... 228/176
5,181,720 A * 1/1993 Stites et al. ..... 473/312
5,509,660 A * 4/1996 Elmer ..... 473/288
5,830,084 A * 11/1998 Kosmatka ..... 473/349
5,971,868 A * 10/1999 Kosmatka ..... 473/349
6,443,857 B1 * 9/2002 Chuang ..... 473/332
6,506,129 B2 * 1/2003 Chen ..... 473/329
6,595,871 B2 * 7/2003 Sano ..... 473/342
6,713,717 B2 * 3/2004 Takeda ..... 219/121.69
6,746,342 B1 * 6/2004 Hsieh ..... 473/342
6,926,618 B2 * 8/2005 Sanchez et al. ..... 473/329
7,121,958 B2 * 10/2006 Cheng et al. ..... 473/345
7,258,628 B2 * 8/2007 Huang et al. ..... 473/342
7,371,188 B2 * 5/2008 Chen ..... 473/329
7,578,754 B2 * 8/2009 Nakamura ..... 473/342

FOREIGN PATENT DOCUMENTS

GB 442557 * 2/1936
JP 6-471 U 1/1994

* cited by examiner

*Primary Examiner*—Sebastiano Passaniti
(74) *Attorney, Agent, or Firm*—Birch, Stewart, Kolasch & Birch, LLP

(57) ABSTRACT

An iron-type golf club head comprises: a main unit made of a carbon steel having a carbon content Ch (wt %) and integrally including a hosel attached to a club shaft; and a face plate made of a carbon steel having a carbon content Cf (wt %) and attached to the main unit so that the front surface of the face plate forms at least a major part of a face of the head, wherein the carbon content Cf (wt %) of the face plate is less than the carbon content Ch (wt %) of the main unit.

8 Claims, 4 Drawing Sheets

IRON-TYPE GOLF CLUB HEAD

BACKGROUND OF THE INVENTION

The present invention relates to an iron-type golf club head, more particularly to a structure for a face plate and a main unit capable of realizing a favorable soft impact feeling.

Iron-type golf club heads made of carbon steels are appreciated by many golfers, especially professional golfers and advanced golfers because of the soft impact feeling and the controllability of the ball at impact. The professional golfers and advanced golfers have an ability to control or adjust the direction of the club head in a moment of contact between the ball and the club face. Such contacting time is very short, but when compared with the club heads made of stainless steels, it is longer, therefore, it is easier to adjust the club head towards the intended direction and ball trajectory.

In the Japanese utility model application publication No. JP-U-6-471 (published on 11 Jan. 1994), there is disclosed a golf club head composed of a face part made of a hard steel containing more than 0.3 wt % of carbon and a main body which is a casting of a soft steel containing less than 0.3 wt % of carbon. In this structure, there is a tendency that the club face becomes hard and the main body becomes softer. Therefore, the soft impact feeling is impaired. Further, the main body with which the hosel is integrally formed, tends to be deformed during use and as a result the loft angle and lie angle get out of order.

SUMMARY OF THE INVENTION

It is therefore, an object of the present invention to provide an iron-type golf club head, in which both of a favorable soft impact feeling and the resistance to deformation can be achieved in a well balanced manner.

According to the present invention, an iron-type golf club head comprises: a main unit made of a carbon steel having a carbon content Ch (wt %) and integrally including a hosel attached to a club shaft; and a face plate made of a carbon steel having a carbon content Cf (wt %) and attached to the main unit so that the front surface of the face plate forms at least a major part of a face of the head, wherein the carbon content Cf (wt %) of the face plate is less than the carbon content Ch (wt %) of the main unit.

The carbon steels become harder as the carbon content increases, therefore, the iron-type golf club head according to the present invention becomes harder in the main unit than the face plate. Accordingly, it becomes possible to realize a favorable soft impact feeling to improve the controllability of the ball at impact, while preventing the main unit from being deformed during use by repeated impacts.

DESCRIPTION OF THE PREFERRED EMBODIMENTS

Figure 1:
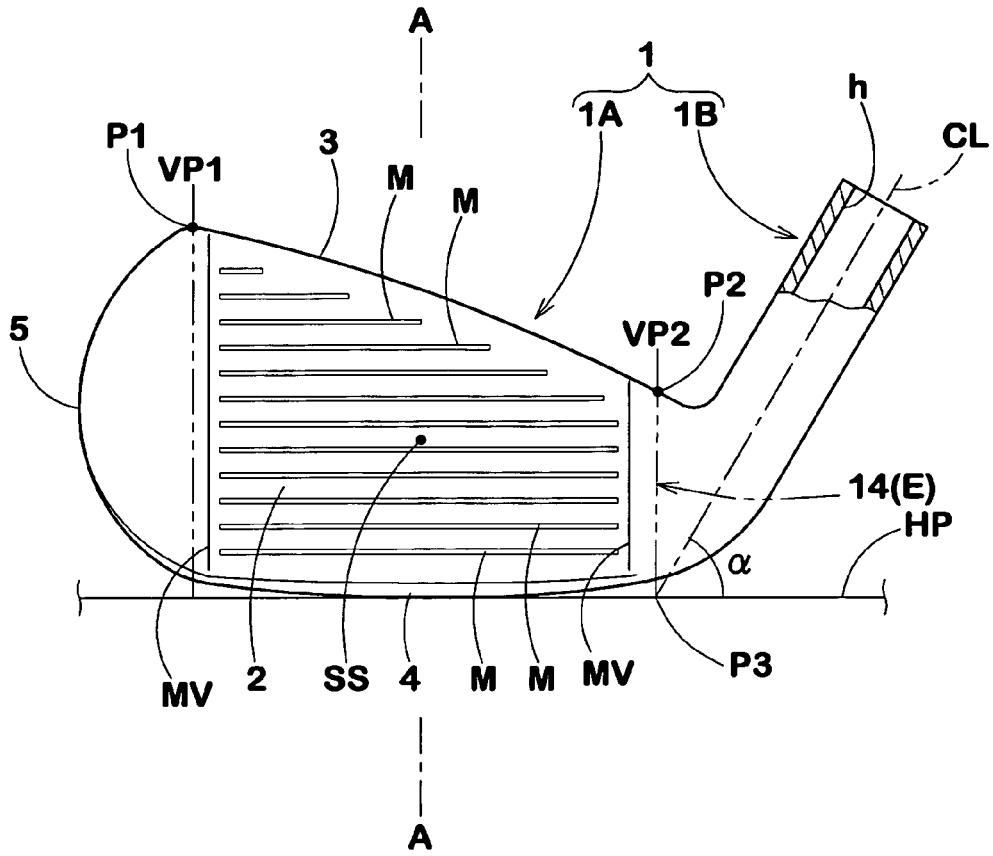
FIG. 1 is a front view of an iron-type golf club head according to the present invention.
Figure 2:
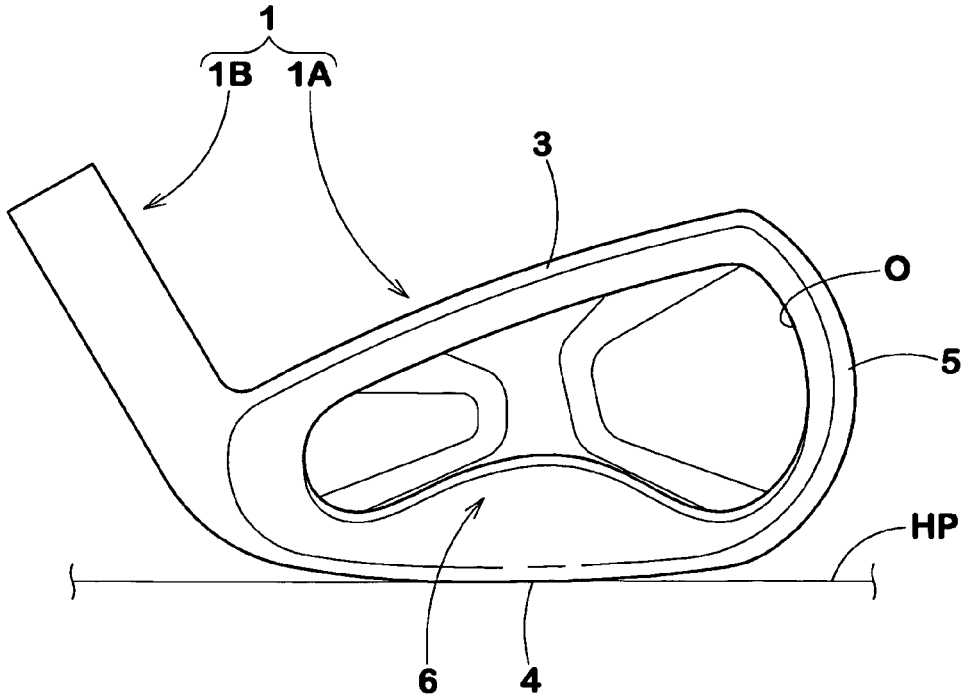
FIG. 2 is a rear view thereof.
Figure 3:
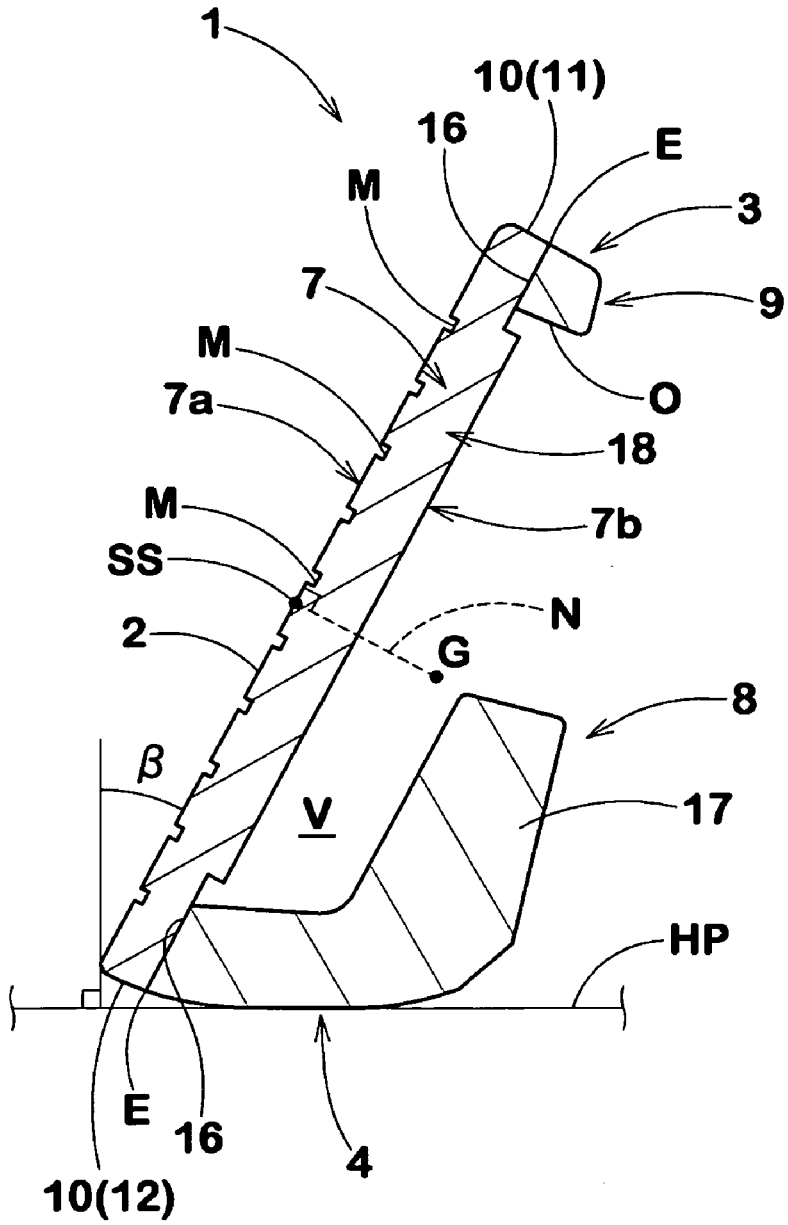
FIG. 3 is a cross sectional view taken along-line A-A in FIG. 1.

Embodiments of the present invention will now be described in detail in conjunction with accompanying drawings.

In the drawings, iron-type golf club head 1 according to the present invention comprises a body 1A and an upwardly protruding hosel 1B.

The body 1A has: a face 2 for hitting a ball, a top surface 3, a sole surface 4, a toe surface 5 and a back surface 6. The surfaces 3-6 each form a part of the outer surface of the club head.

The hosel 1B is positioned on the heel-side of the body 1A and attached to a club shaft (not shown).

In this application, the dimensions and positions refer to those under the standard state of the club head unless otherwise noted. The standard state is defined such that the golf club head 1 is placed on a horizontal plane HP so that the center line CL of the club shaft or shaft inserting hole (h) of the hosel 1B is inclined at the lie angle alpha while keeping the center line CL on a first vertical plane, and the face 2 forms its loft angle beta with respect to the first vertical plane. The undermentioned sweet spot SS is defined as the point of intersection between the face 2 and a straight line N drawn normally to the face 2 passing the center of gravity G of the golf club head. The back-and-forth direction is a direction parallel with the straight line N projected on the horizontal plane HP. The heel-and-toe direction is a direction parallel with the horizontal plane HP and perpendicular to the back-and-forth direction. The up-and-down direction a direction perpendicular to the horizontal plane HP.

The above-mentioned face 2 is defined as being on the toe side of a heel-side vertical plane VP2 which plane VP2 is perpendicular to the first vertical plane and includes the intersecting point P3 of the center line CL with the horizontal plane HP. The top surface 3 is defined as being between the heel-side vertical plane VP2 and a toe-side vertical plane VP1, which plane VP1 is parallel with the heel-side vertical plane VP2 and includes the highest point P1 on the toe side. The sole surface 4 is defined as being between the toe-side vertical plane VP1 and the heel-side vertical plane VP2. The toe surface 5 is defined as being on the toe side of the toe-side vertical plane VP1.

In this embodiment, in the front view of the head, the top surface 3 or top edge of the face 2 extends substantially straight, inclining downwards towards the heel. The sole surface 4 extends almost straight or with a slight curvature, in substantially parallel with the horizontal direction. The toe surface 5 is convexly curved.

According to the present invention, the club head 1 is composed of a main unit 8, a face plate 7 and optionally a weight member (not shown).

The main unit 8 integrally includes: a main frame 9 for supporting the face plate 7 and the above-mentioned hosel 1B.

The hosel 1B is provided with a shaft inserting hole (h) into which an end of a club shaft is inserted.

The main frame 9 is provided with a through hole O penetrating in the back-and-forth direction, and extends continuously around the through hole O so that the main frame 9 contacts with only the peripheral part of the back surface 7*b* of the face plate 7.

The face plate 7 is attached to the main unit 8, and the front surface 7*a* thereof forms at least a major part of (in this embodiment the whole of) the face 2. The front surface 7*a* is a substantially flat single plane and is provided with impact area markings M and vertical lines MV. But, the back surface 7*b* of the face plate 7 is not flat as hereinafter described. The face plate 7 has a certain thickness ts at the peripheral edge 10, as a result, the peripheral edge 10 continues around the face plate, forming an annular peripheral surface between the front surface 7*a* and back surface 7*b*.

Incidentally, the impact area markings mean grooves and punch marks which are formed in comply with golf rules, regulations or the like. In the example shown in FIG. 1, the impact area markings M are score lines, namely, parallel grooves extending in the toe-heel direction.

According to the present invention, the face plate 7 and the main unit 8 are made of different carbon steels in respect of the carbon content.

The carbon content Cf of the face plate 7 is less than the carbon content Ch of the main unit 8.

Here, the carbon steel means an alloyed steel comprising: 0.02 to 2 wt % of carbon; the balance being essentially Fe; and a slight amount of impurities such as Si, Mn, P and S.

If the main unit 8 is made of a stainless steel and the face plate 7 is made of a carbon steel, soft impact feelings can not be obtained. The reason is considered that the softer face plate 7 is supported by the rigid stainless steel, as a result, the rigidity of the club head as a whole is increased and the impact feeling becomes hard. Therefore, in order to obtain a favorable soft impact feeling, both of the face plate 7 and main unit 8 have to be made of carbon steels.

If the carbon content Cf of the face plate 7 is too less, although soft impact feelings can be obtained, there is a possibility that the tensile strength of the face plate 7 becomes insufficient and the durability is decreased. Therefore, the carbon content Cf is preferably not less than 0.10 wt %, more preferably not less than 0.15 wt %, still more preferably not less than 0.18 wt %.

If the carbon content cf is too much, on the other hand, although the tensile strength of the face plate 7 is increased and the durability can be improved, it is difficult to obtain a favorable soft impact feeling with the increase in the hardness. Therefore, the carbon content Cf is preferably not more than 0.30 wt %, more preferably not more than 0.27 wt %, still more preferably not more than 0.24 wt %.

If the carbon content Ch of the main unit 8 is too less, there is a possibility that the hosel 1B is deformed during repeating ball hitting since the tensile strength of the main unit 8 is decreased. Therefore, the carbon content Ch is preferably not less than 0.20 wt %, more preferably not less than 0.23 wt %, still more preferably not less than 0.25 wt %, yet still more preferably not less than 0.27 wt %.

On the other hand, if the carbon content Ch is too much, the steel becomes embrittled, and the workability is lowered. Therefore, the carbon content Ch is preferably not more than 0.40 wt %, more preferably not more than 0.35 wt %, still more preferably not more than 0.30 wt %.

In order to achieve soft impact feeling and the resistance to deformation of the main unit 8 in a well balanced manner, the ratio (Cf/Ch) of the carbon content Cf of the face plate 7 to the carbon content Ch of the main unit 8 is preferably set in a range of not less than 0.30, more preferably not less than 0.40, still more preferably not less than 0.50, but not more than 0.90, more preferably not more than 0.85, still more preferably not more than 0.80.

If the mass Wf of the face plate 7 is too small, the face plate 7 becomes too small in comparison with the main unit 8, as a result, there is a possibility that the rigidity of the club head 1 as a whole is excessively increased, and the impact feeling is deteriorated. Therefore, the mass Wf of the face plate 7 is preferably not less than 60 g, more preferably not less than 70 g, still more preferably not less than 80 g. If the mass Wf is too large, on the other hand, the face plate 7 becomes too large, as a result, there is a possibility that the rigidity of the club head 1 as a whole is decreased and the durability is deteriorated. Therefore, the mass Wf of the face plate 7 is preferably not more than 150 g, more preferably not more than 140 g, still more preferably not more than 130 g.

If the mass Wh of the main unit 8 is too small, the main unit 8 becomes relatively small, and there is a possibility that the rigidity of the club head 1 as a whole is decreased and the durability is decreased. Therefore, the mass Wh of the main unit 8 is preferably not less than 140 g, more preferably not less than 150 g, still more preferably not less than 160 g. If the mass Wh is too large, on the other hand, the main unit 8 becomes relatively large, and there is a possibility that the rigidity of the club head 1 as a whole excessively increased and the impact feeling can not be improved. Therefore, the mass Wh of the main unit 8 is preferably not more than 230 g, more preferably not more than 220 g, still more preferably not more than 210 g.

It is especially desirable for both of the impact feeling and durability that the ratio (Wf/Wh) of the mass Wf of the face plate 7(*g*) to the mass Wh of the main unit 8(*g*) is not less than 0.30, preferably not less than 0.35, more preferably not less than 0.40, but not more than 1.0, preferably not more than 0.90, more preferably not more than 0.80.

In this embodiment, the carbon steel of the face plate 7 and the carbon steel of the main unit 8 have substantially same specific gravities. Accordingly, the above-mentioned ratio (Wf/Wh) is substantially same as the ratio (Vf/Vh) of the volume Vf (cm^3) of the face plate 7 to the volume Vh (cm^3) of the main unit 8.

Meanwhile, if the mass of the club head 1 is less than 180 g, since the club head is too light, it becomes difficult to achieve a good swing balance. Therefore, the mass of the club head 1 is preferably set in a range of not less than 180 g, more preferably not less than 190 g, still more preferably not less than 200 g. In order to adjust the mass of the club head 1, a separate weight member can be be attached to the main unit 8. On the contrary, if the mass is increased more than 340 g, it becomes difficult to swing through the ball, and there is a possibility that the carry distance and the directionality of the hit ball become worse. Therefore, the mass of the club head 1 is preferably set in a range of not more than 340 g, more preferably not more than 330 g, still more preferably not more than 320 g.

The above-mentioned main unit 8 comprises the main frame 9 and a back wall 17.

The back wall 17 extends upwards from the lower part of the main frame 9, while leaving a space from the face plate 7, as a result, a pocket cavity v is formed behind the back surface 7*b* of the face plate 7. This structure distributes a large mass backwards of the head, therefore, the moment of inertia of the head 1 can be increased to improve the directionality of the hit ball.

The main frame 9 has a support surface 16 which is formed around the through hole O and contacts with the peripheral edge portion J of the back surface 7*b* of the face plate 7.

The support surface 16 supports the peripheral edge portion J of the back surface 7*b*, therefore, the face plate 7 has an unsupported area Ya corresponding to the through hole O. The unsupported area Ya can deflected at impact and the coefficient of restitution can be improved. The unsupported area Ya of the face plate 7 has to include the sweet spot SS.

Figure 5:
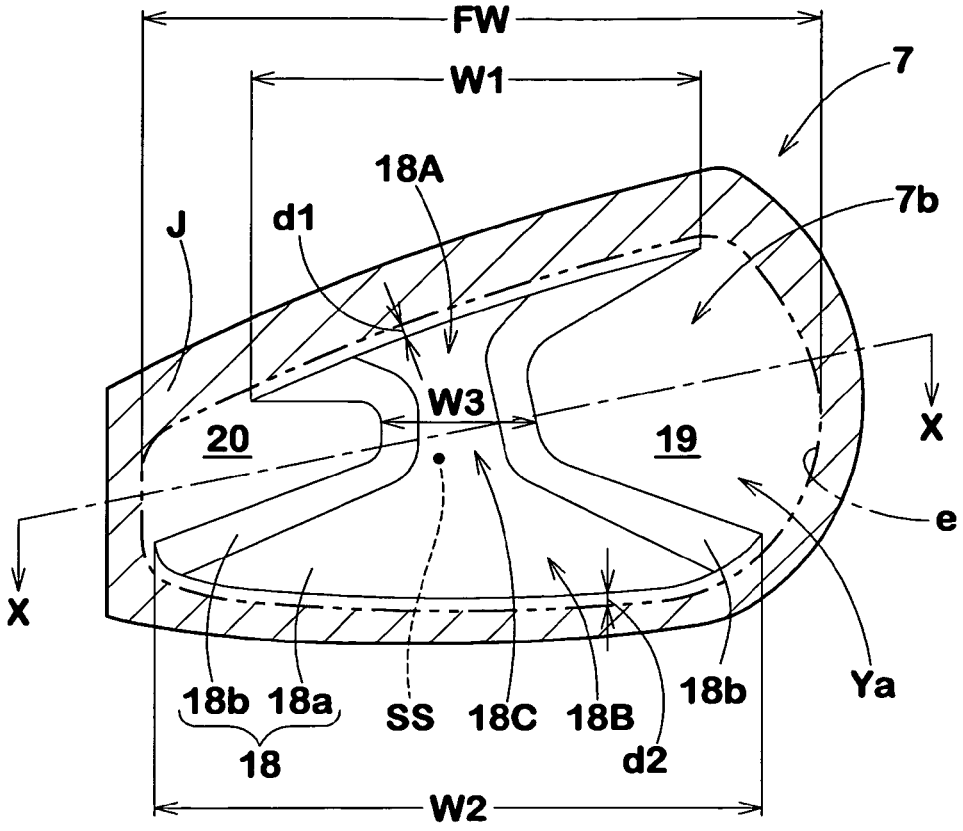
FIG. 5 is a rear view of the face plate of the head.
Figure 6:
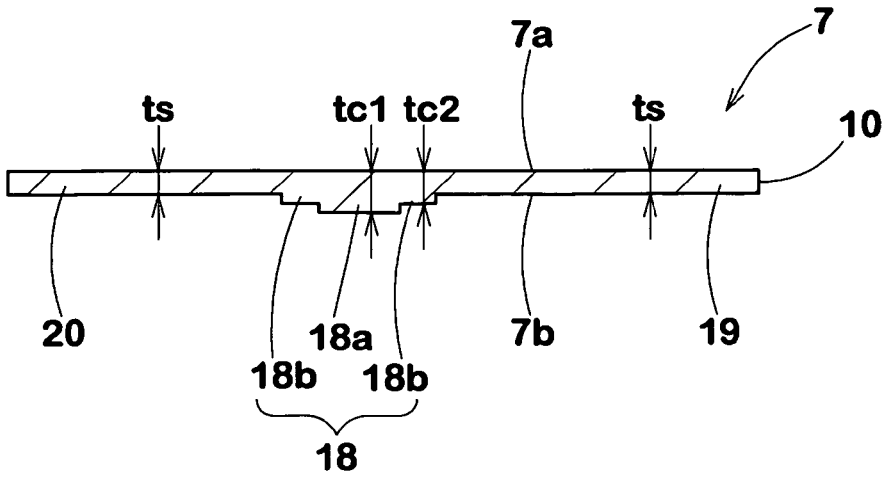
FIG. 6 is a cross sectional view taken along line X-X in FIG. 5.

FIG. 5 shows the back surface 7*b* of the face plate 7, wherein the peripheral edge portion J supported by the support surface 16 is hatched. The remaining unsupported area Ya is not hatched. The edge (e) of the unsupported area Ya is indicated by two-dot-dashed line.

Preferably, the area (A) of the peripheral edge portion J, namely, the contact area between the support surface 16 and the back surface 7*b* is set in a range of not less than 200 sq. mm, more preferably not less than 210 sq. mm, still more preferably not less than 220 sq. mm in order to increase the junction strength therebetween.

However, if the area (A) is too large, the unsupported area Ya becomes decreased, and the deflection of the face plate 7 at impact is restrained and there is a possibility that the carry distance is decreased. Therefore, the contact area (A) is preferably not more than 1500 sq. mm, more preferably not more than 1400 sq. mm, still more preferably not more than 1300 sq. mm.

In this embodiment, the area of the front surface 7*a* of the face plate 7 equals to the area of the face 2. The area of the front surface 7*a* has to be not less than 50%, preferably not less than 60%, more preferably not less than 70% of the area of the face 2 to effectively deflect the face plate 7 at impact.

Figure 4:
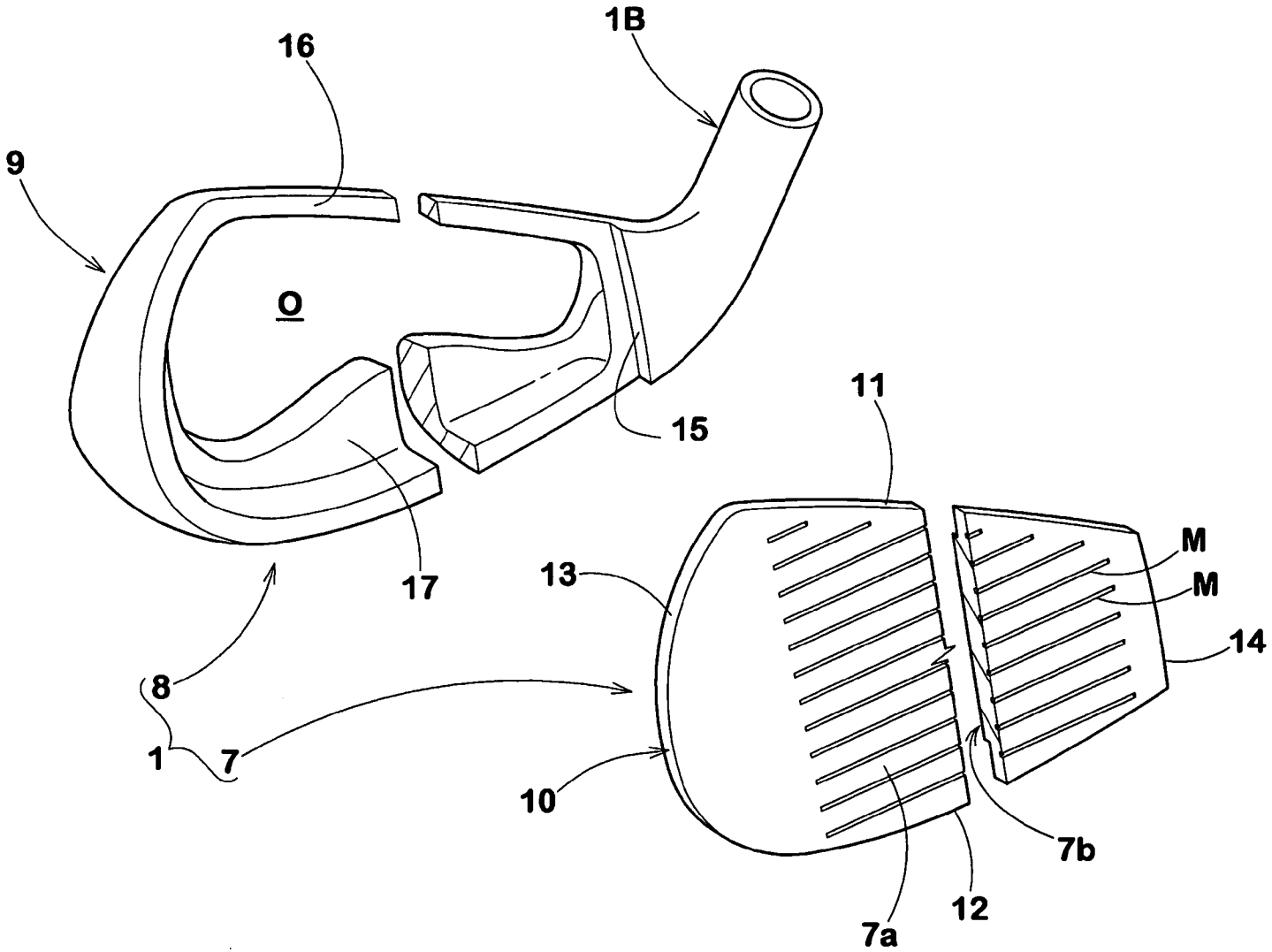
FIG. 4 is an exploded perspective view of the head.

In order to promote the deflection of the face plate 7 at impact, it is desirable to increase the area of the unsupported area Ya. For that purpose, it is desirable that the face plate 7 is extended to or near the outer surface of the club head 1 as much as possible. In other words, preferably at least one of the upper edge 11 and lower edge 12; more preferably two of the upper edge 11, lower edge 12 and toe-side edge 13; most preferably all of the three edges 11, 12 and 13 are exposed in the outer surface (top surface 3, sole surface 4 and toe surface 5) of the club head, forming a part of the outer surface. In the case of the heel-side edge 14 of the face plate 7, however, the heel-side edge 14 is not exposed since the hosel exists, but the face plate 7 is extended to the heel-side extreme end of the face 2 (namely to the position of the above-mentioned heel-side vertical plane VP2) instead. The heel-side edge 14 is butted with a heel-side support wall 15 of the main unit 8 which is, as shown in FIG. 4, formed perpendicularly to the support surface 16 along the heel-side edge of the support surface 16. In the present invention, however, it is not improbable that the entirety of the peripheral edge 10 is not exposed in the outer surface of the head.

With the unsupported area Ya increases, there is a tendency that the durability of the face plate 7 is decreased. Therefore, the back surface 7*b* of the face plate 7 is provided in a central region in the toe-heel direction with a thick part 18. The thick part 18 is disposed within the unsupported area Ya, without contacting the main frame 9. As a result, a toe-side thinner part 19 and a heel-side thinner part 20 are formed on the toe-side and heel-side of the thick part 18, respectively.

In this embodiment, the thick part 18 is made up of: a top-side thick part 18A extending in the toe-heel direction on the top surface 3 side; a sole-side thick part 18B extending in the toe-heel direction on the sole surface 4 side; and a narrow width middle thick part 18C extending from the sole-side thick part 18B to the top-side thick part 18A So that, in the rear view, the thick part 18 has a shape like the cross section of a rail. Namely, the width of the thick part 18 in the toe-heel direction becomes minimum (W3) in the middle thick part 18C, and increases towards the top surface 3 side and the sole surface 4 side at an accelerating pace.

The minimum width W3 is preferably not more than 40%, more preferably not more than 30% of the maximum width FW of the unsupported area Ya of the face plate 7 in the toe-heel direction. If however, the minimum width W3 is too small, the durability is liable to decrease, therefore, the minimum width W3 is preferably not less than 5%, more preferably not less than 10%, still more preferably not less than 15% of the maximum width FW.

The width W1 of the top-side thick part 18A in the toe-heel direction and the width W2 of the sole-side thick part 18B in the toe-heel direction are preferably not less than 50%, more preferably not less than 60% of the maximum width FW.

In order to prevent the thick part 18 from contacting with the main frame 9 at impact, the thick part 18 is terminated while leaving a space from the main frame 9. The minimum distance d1 between the upper edge of the top-side thick part 18A and the edge (e) of the support surface 16, and the minimum distance d2 between the lower edge of the sole-side thick part 18B and the edge (e) of the support surface 16 are not less than 0.05 mm, preferably not less than 0.3 mm, more preferably not less than 0.5 mm. But, the minimum distances d1 and d2 are not more than 2.0 mm, preferably not more than 1.8 mm, more preferably not more than 1.5 mm in order to prevent the moment of inertia of the head around a horizontal axis passing through the center of gravity G from decreasing.

If the thickness ts of the thinner parts 19 and 20 is too small, there is possibility that the durability is decreased and deformation is caused. Therefore, the thickness ts is preferably not less than 2.6 mm, more preferably not less than 2.8 mm, still more preferably not less than 3.0 mm. If the thickness ts is too large, on the other hand, the unsupported area Ya of the face plate 7 becomes hard to deflect, and the carry distance tends to decrease. Therefore, the thickness ts is preferably not more than 3.5 mm, more preferably not more than 3.4 mm, still more preferably not more than 3.3 mm. The face plate 7 in this example has the constant thickness ts excepting the thick part 18.

The thickness tc(tc1, tc2) of the thick part 18 is preferably set in a range of not less than 3.4 mm, more preferably not less than 3.5 mm, still more preferably not less than 3.6 mm in order to secure the durability of the face plate 7. If however the thickness tc(tc1, tc2) of the thick part 18 is too large, there is a possibility that the directionality of the hit ball is deteriorated because the thick part 18 is located in the central region of the unsupported area Ya and the moment of inertia of the club head 1 around the vertical axis passing through the center of gravity G is decreased. Therefore, it is preferred that the thickness tc(tc1, tc2) is not more than 4.3 mm, more preferably not more than 4.1 mm, still more preferably not more than 3.9 mm.

Further, it is preferable that the thickness tc of the thick part 18 is increased towards its central portion gradually (in this example stepwise). In this example, therefore, the thick part 18 is made up of: a first thick part 18*a* formed in a central portion and having a thickness tc1; and a secondary thick part 18*b* having a smaller thickness tc2 (<tc1) and formed on each side (toe-side and heel-side) of the first thick part 18*a* so as to extend across the almost full height of the back surface 7*a*. In the case of the stepwise thickness increase, the difference between the adjacent thicknesses (in this example tc1−tc2) is preferably not more than 0.8 mm, more preferably not more than 0.6 mm.

Therefore, it is further assured that the necessary deflection at impact is secured without sacrificing the durability, and the impact feeling and carry distance can be further improved in cooperation with the use of the carbon steel in the face plate 7. Further, the top-side and sole-side thick parts 18A and 18B can distribute a further mass in the upper part and lower part of the face 2, and can increase the moment of inertia of the head around a horizontal axis passing through the center of gravity G. Therefore, if a shot is off centered in the up-and-down direction, the motion of the club head is reduced.

The face plate 7 and main unit 8 can be manufactured by various methods, but forging is preferred because a compact homogeneous crystal structure superior in the durability can be provided. Here, the forging includes "cold forging" at room temperature, "warm forging" at an under recrystallization temperature and "hot forging" at an over recrystallization temperature, which may be made using a die, hammer, press or the like.

The face plate 7 and main unit 8 are welded along the boundary E between the main unit 8 and the face plate 7 which boundary E appears in the outer surface of the club head. In this embodiment, the boundary E appears in the top surface 3, toe surface 5 and sole surface 4 and also the front surface (face 2) of the head. For example, laser welding, plasma welding, TIG welding and the like can be utilized.

Comparison Tests

Iron-type club heads for fifth iron (loft 27 degrees, lie 61 degrees) were made and tested for the impact feeling, the controllability of the ball at impact and durability.

All of the heads had identical structures shown in FIG. 4 excepting the carbon contents as shown in Table 1. Although the carbon contents were changed, all of the carbon steels showed the same specific gravity of 7.9 g/cm^3. The face plate and main unit were forged and laser welded.

Impact feeling test and controllability test:

Each of the heads was attached to a steel shaft (Nippon shaft Co. Ltd. "NS950") to make a fifth iron, and seven golfers with a handicap of 5 hit three-piece balls (SRI Sports Limited "SRIXON Z-UR") five times per person.

The seven golfers evaluated the impact feeling into the following five ranks, 5:very soft, 4:soft, 3:average, 2:hard, and 1:very hard. The test results which are mean values for the seven golfers are shown in Table 1.

At the same time, the distance between the intended target position and the actual ball stop position was measured at each shot as an index of the controllability of the ball at impact. The test results which are mean values of five shots across the seven golfers are shown in Table 1, wherein the smaller value is better.

Durability Test:

Each of the above-mentioned clubs was mounted on a swing robot and hit the golf balls 5000 times at a head speed of 42 m/s. Then, the amount of dent of the club face and a change in the loft angle were measured as an index of the durability. The test results are shown in Table 1, wherein the smaller value is better.

From the test results, it was confirmed that the impact feeling, controllability and durability can be effectively improved.

The invention claimed is:

1. An iron-type golf club head comprises:

a main unit made of a carbon steel having a carbon content Ch (wt %) and integrally including a hosel; and a face plate made of a carbon steel having a carbon content Cf (wt %) and attached to the main unit, wherein the carbon content Cf (wt %) of the face plate is not less that 0.10 wt % and not more than 0.30 wt %, the carbon content Ch (wt %) of the main unit is not less that 0.20 wt % and not more than 0.40 wt %, and the ratio (Cf/Ch) of the carbon content Cf (wt %) of the face plate to the carbon content Ch (wt %) of the main unit is not less that 0.30 and not more than 0.90.

2. The golf club head according to claim 1, wherein the ratio (Cf/Ch) of the carbon content Cf (wt %) to the carbon content Ch (wt %) is not less that 0.40 and not more than 0.85.

3. The golf club head according to claim 1, wherein the face plate has an upper edge, a lower edge, a toe-side edge and a heel-side edge, and at least a part of the upper edge, lower edge and toe-side edge is exposed in the outer surface of the head.

4. The golf club head according to claim 1, wherein the main unit comprises: a main frame extending annularly around a through hole so as to support a peripheral edge portion of a back surface of the face plate and also to form an unsupported area surrounded by the supported peripheral edge portion, and said back surface is provided in the unsupported area with a thick central part defining a thinner part on each of the toe-side and heel-side of the thick central part.

5. The golf club head according to claim 4, wherein said thick central part comprises:

an upper thick part extending in the toe-heel direction;

a lower thick part extending in the toe-heel direction; and a middle thick part extending from the upper thick part to the lower thick part and having the smallest width in the toe-heel direction.

6. The golf club head according to claim 1, 2, 3, 4 or 5, wherein the mass Wf of the face plate is not less that 60 g and not more than 150 g, the mass Wh of the main unit is not less that 140 g and not more than 230 g, and the ratio Wf/Wh of the mass Wf of the face plate to the mass Wh of the main unit is not less that 0.30 and not more than 1.0.

7. An iron-type golf club head comprises:

a main unit made of a carbon steel having a carbon content Ch (wt %) and integrally including a hosel; and

TABLE 1

| Head | Ex. 1 | Ex. 2 | Ex. 3 | Ref. 1 | Ref. 2 | Ex. 4 |
|---|---|---|---|---|---|---|
| Face plate: Carbon content Cf (wt %) | 0.20 | 0.18 | 0.15 | 0.15 | 0.30 | 0.05 |
| Main unit: Carbon content Ch (wt %) | 0.25 | 0.27 | 0.30 | 0.15 | 0.30 | 0.25 |
| Cf/Ch | 0.80 | 0.67 | 0.50 | 1.00 | 1.00 | 0.20 |
| Face plate: Mass Wf (g) | 84.0 | 84.0 | 84.0 | 84.0 | 84.0 | 84.0 |
| Main unit: Mass Wh (g) | 168.0 | 168.0 | 168.0 | 168.0 | 168.0 | 168.0 |
| Wf/Wh | 0.50 | 0.50 | 0.50 | 0.50 | 0.50 | 0.50 |
| Test results | | | | | | |
| Impact feeling | 4.6 | 4.6 | 4.7 | 4.7 | 3.5 | 4.8 |
| Controllability (m) | 5.1 | 5.0 | 4.1 | 4.1 | 9.2 | 4.0 |
| Durability | | | | | | |
| Face dent (mm) | under 0.1 | under 0.1 | under 0.1 | under 0.1 | under 0.1 | 0.4 |
| Loft angle change (degree) | 0 | 0 | 0 | 1.0 | 0 | 0 |

a face plate made of a carbon steel having a carbon content Cf (wt %) and attached to the main unit, wherein the face plate has an upper edge, a lower edge, a toe-side edge and a heel-side edge, and at least a part of the upper edge, lower edge and toe-side edge is exposed in the outer surface of the head, the main unit comprises: a main frame extending annularly around a through hole so as to support a peripheral edge portion of a back surface of the face plate and also to form an unsupported area surrounded by the supported peripheral edge portion, said back surface is provided in the unsupported area with a thick central part defining a thinner part on each of the toe-side and heel-side of the thick central part, said thick central part comprises: an upper thick part extending in the toe-heel direction; a lower thick part extending in the toe-heel direction; and a middle thick part extending from the upper thick part to the lower thick part and having the smallest width in the toe-heel direction, the carbon content Cf (wt %) of the face plate is not less that 0.10 wt % and not more than 0.30 wt %, the carbon content Ch (wt %) of the main unit is not less that 0.20 wt % and not more than 0.40 wt %, and the ratio (Cf/Ch) of the carbon content Cf (wt %) of the face plate to the carbon content Ch (wt %) of the main unit is not less that 0.40 and not more than 0.85.

8. The golf club head according to claim 7, wherein the mass Wf of the face plate is not less that 60 g and not more than 150 g, the mass Wh of the main unit is not less that 140 g and not more than 230 g, and the ratio Wf/Wh of the mass Wf of the face plate to the mass Wh of the main unit is not less that 0.30 and not more than 1.0.

* * * * *